United States Patent [19]

Blome

[11] Patent Number: 4,823,515

[45] Date of Patent: Apr. 25, 1989

[54] ADJUSTABLE SANDING DEVICE

[76] Inventor: Robert W. Blome, 2360 Memorial Dr., Brookfield, Wis. 53005

[21] Appl. No.: 179,748

[22] Filed: Apr. 11, 1988

[51] Int. Cl.[4] ..... B24D 17/00

[52] U.S. Cl. ..... 51/363; 51/372; 51/391

[58] Field of Search ..... 51/363, 358, 372, 375, 51/389, 390, 391

[56] References Cited

U.S. PATENT DOCUMENTS 1,839,557 1/1932 Hilwig ..... 51/389

*Primary Examiner*—Frederick R. Schmidt
*Assistant Examiner*—Maurina Rachuba
*Attorney, Agent, or Firm*—James L. Kirschnik

[57] ABSTRACT

An adjustable sanding device for sanding curved surfaces includes a flexible membrane which serves as a support surface for an abrasive medium. Opposing edges of the membrane are supported and secured to spaced plates interconnected by an adjustable and pivotable linkage which permits the relationship between the planes of the support plates to be varied both angularly and spacially to permit the radius of curvature of the free portion of the membrane to be selectively varied. Locking bolts are provided for securing the relative positions of the plates and linkage in a variety fixed preselected positions. As an alternative, the plates may be pivotally joined along one edge and the oppsoing membrane edges secured to the free edge of each plate with the radius of curvature of the membrane varied as the angle between the plates is varied. A locking linkage is also provided to lock the angle between the plates in a preselected position.

9 Claims, 4 Drawing Sheets

ADJUSTABLE SANDING DEVICE

FIELD OF THE INVENTION

This invention relates to adjustable sanding devices for supporting an abrasive surface in a predetermined curved, beveled, or combination curved and beveled position. While it is more particularly addressed to model making where varying degrees of curved surfaces such as the leading edges of an airplane airfoil surface are to be formed by sanding to a final cross sectional configuration other uses and applications of the invention will be apparent.

DESCRIPTION OF PRIOR ART

In model making, particularly involving kits for construction of model airplanes, the model builder must often deal with constructing and finishing curved, beveled or a combination of curved and beveled surfaces. In many kits, an airplane wing, for example, may be built up from various pieces of raw material such as balsa wood. Often rectangular or beveled shapes of materials are glued together or formed from blocks to construct a solid leading edge. Such kits typically include templates or drawing figures showing the model builder the arcuate configuration of the leading edge cross section and the builder then shapes the leading edge along its entire length to match the template or drawing. Some kits provide precut shapes or solid geometric pieces which may be used to construct a sanding tool or jig device having a fixed cross sectional angle or curve for supporting an abrasive material. Additionally, sanding blocks are marketed and sold which may include fixed curved semicircular depressions or convex shapes with abrasive material applied to a surface for sanding a curved edge or corner or a convex surface. To applicant's knowledge, no one is currently providing a device for holding sand paper which is adjustable and which provides a support surface for holding abrasive materials in a fixed curved, beveled or the combination of a curved and beveled shape.

SUMMARY OF THE INVENTION

It is an object of the invention to provide a device for sanding curved or curved and beveled surfaces which is adjustable to conform to various sizes of cross sections.

Another object of the invention is to provide an adjustable device for holding an abrasive medium in a predetermined and fixed curved or curved and beveled cross section.

The objects and advantages of the invention are provided by using two rigid support surfaces interconnected by pivotable links which permit the spacial relationship of the planes of the support surfaces relative to each other to be infinitely varied from parallel to a 90° intersecting position. A flexible membrane is connected to both support surfaces and includes a freely movable portion for supporting an abrasive medium. As the support surface planes are moved, the free portion of the membrane will assume an arcuate shape between the two support surfaces which shape will vary with the relative angle between the support surface planes and distance between them. The cross sectional configuration of the free portion of the membrane may vary from a simple semicircular arc to a combination arc and bevel shape. The connecting linkage also permits adjustment of the distance between the two support surfaces to increase or decrease the same which will affect the length of radius of the free membrane between them. Means are provided for locking the support surface and linkage positions once a preselected shape is arrived at.

DESCRIPTION OF A PREFERRED EMBODIMENT

Figure 1:
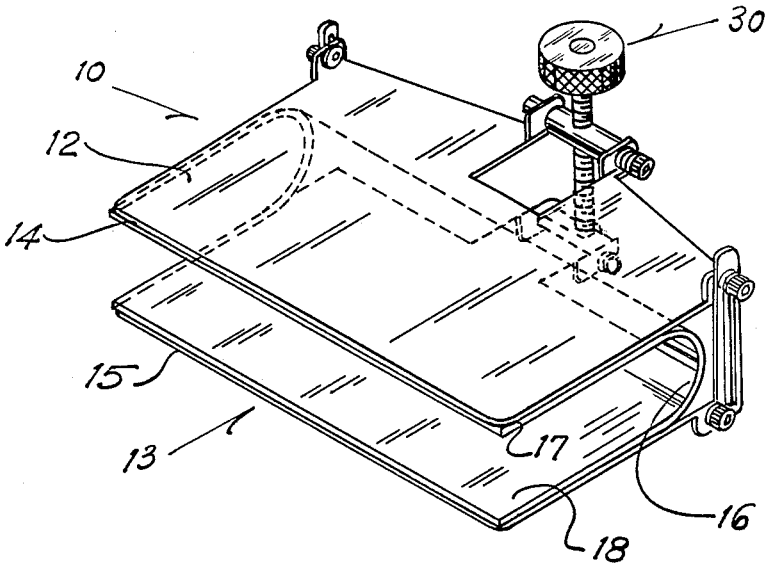
FIG. 1 is an isometric view of an adjustable sanding device according to the invention.
Figure 2:
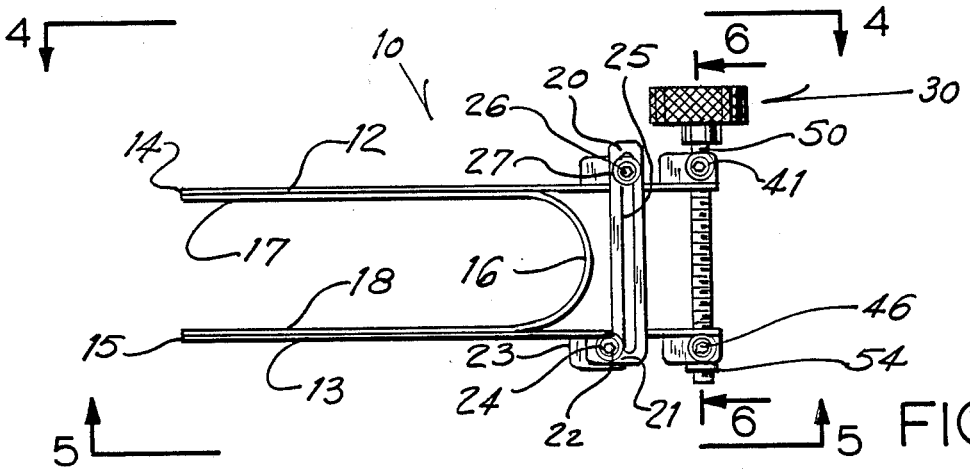
FIG. 2 is a side elevation view of the adjustable sanding device.
Figure 3:
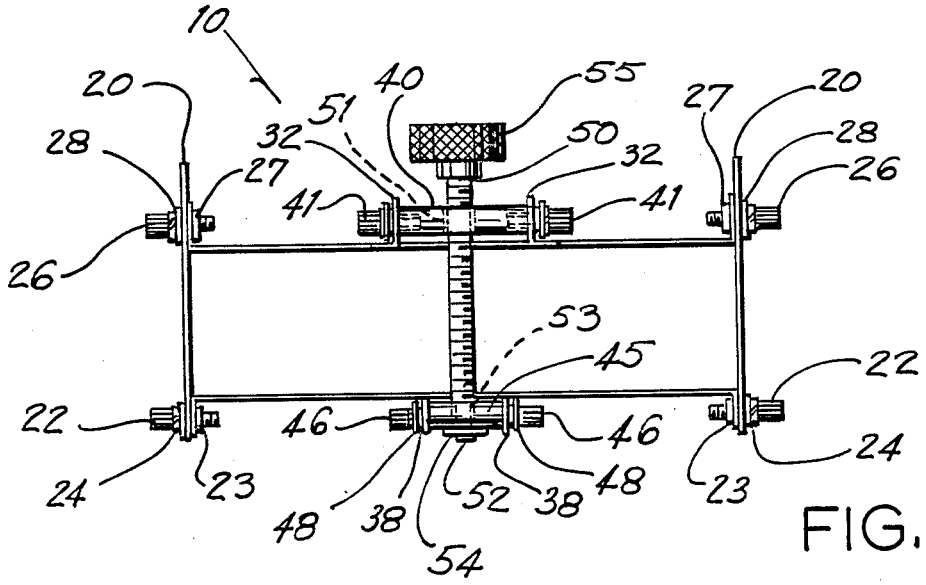
FIG. 3 is a rear elevation view of the sanding device.

Referring to FIGS. 1, 2, and 3, an adjustable sanding device 10 according to the invention includes a first or top support surface in the form of a plate 12 having a generally rectangular planar shape and a second support surface or bottom plate 13. As best seen in FIGS. 1 and 2, the plates 12 and 13 are shown spaced apart with their surface planes generally parallel to each other and with the front edge 14 of plate 12 in substantial alignment with the front edge 15 of plate 13. Between the two plates, a flexible membrane 16 is provided with the top front portion 17 of the membrane affixed securely along its entire width to the bottom of plate 12 starting at the front edge 14 and extending rearwardly for a predetermined distance to a free portion of the membrane. The opposite end of the membrane 16 is aligned with its lower front portion 18 also affixed securely along its entire width to the top portion of bottom plate 13 commencing at the leading edge 15 and extending rearwardly for a predetermined distance to the free portion of the membrane. The remaining portion of the membrane 16 is thus free to assume an arcuate shape as shown in FIG. 2, and the precise radius of curvature of the free portion of the membrane will vary depending upon the distance and angular relationship between the top and bottom plates 12 and 13 as will be described in more detail hereinafter.

As seen in FIGS. 1, 2, and 3, intermediately located along each side of the two plates 12 and 13 are connecting links 20. Each link 20 is elongated and includes a lower 90° extension portion 21 having a bore, not shown, through which a lower pivot bolt 22 extends with each bolt 22 threaded into a downwardly extending reinforced tab 23 affixed to the lower plate 13 on each side of the plate. Washers 24 may be provided between the head of bolt 22 and the link extension 21. The bore, not shown, through the extension portion 21 is sized to permit free pivotability of each link 20 around its corresponding pivot bolt 22. The elongated extension portion 21 of each link 20 includes an elongated channel 25 formed therein and through which an upper pivot bolt 26 extends on each side of the upper plate 12. Each bolt 26 is threaded into an upstanding reinforced tab 27 attached to the sides of upper plate 12 and may also include a pivot washers 28 between the head of each bolt 26 and link 20.

It will thus be appreciated that tightening each of the bolts 22 and 26 will anchor the position of the plates 12 and 13 relative to link 20 by virtue of the friction forces generated by tightening the pivot bolts 22 and 26. Equally apparent, the loosening of the bolts 22 and 26 on both sides of the plates 12 and 13 will permit the links 20 to be pivoted around bolts 22 and the position of upper bolt 26 varied within the channel 25 of link 20 to permit the distance between the two plates 12 and 13 to be varied as well as the angular relationship of the surface planes of the two plates 12 and 13.

Figure 5:
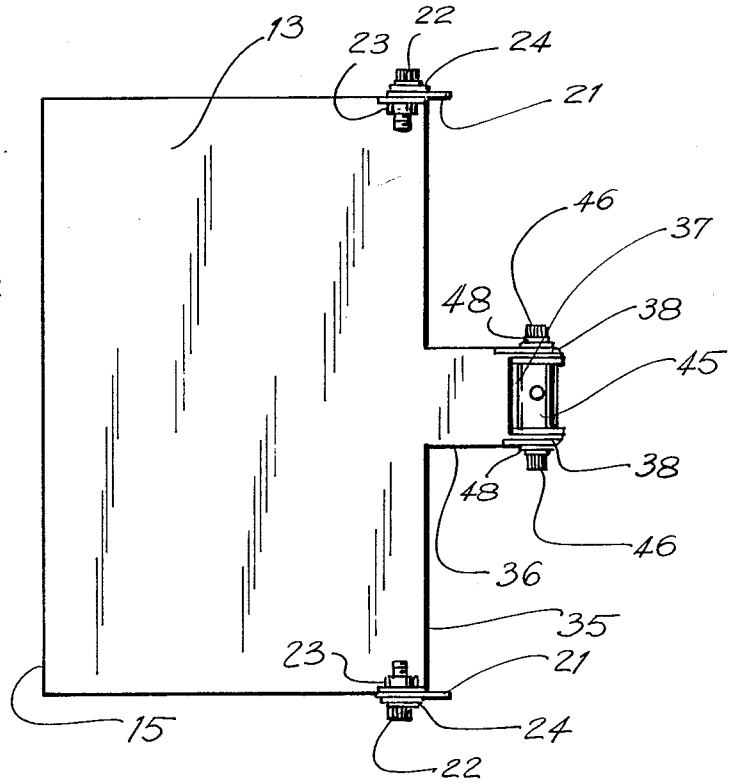
FIG. 5 is a view taken along lines 5—5 of FIG. 2.
Figure 4:
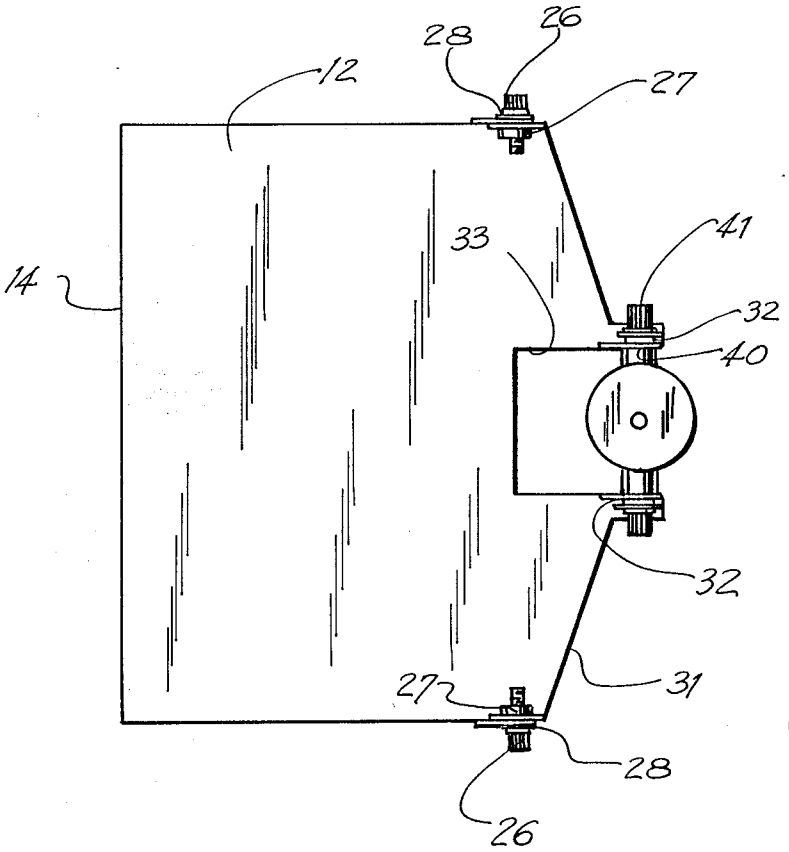
FIG. 4 is a view taken along lines 4—4 of FIG. 2.

As best seen in FIGS. 1, 2, 3, and 6, the rear of the two plates includes a pivoting adjustable screw assembly 30, however, before describing the details of this, reference is made to FIGS. 4 and 5. FIG. 4 shows a top view of the top plate 12 with the rear of plate 12 having angled end edges 31 which terminate at spaced rear upper reinforced extension tabs 32 and having a generally rectangular central aperture 33 formed in the rear of plate 12 and opening between the upper extension tabs 32.

The bottom plate 13 shown in FIG. 5 has a straight rear edge 35 parallel to the front edge 15 of the lower plate with a central generally rectangular extension 36. The extension 36 also has a central aperture 37 formed between spaced lower reinforced extension tabs 38.

As seen in FIGS. 2, 3, 4, and 6, the upper rear extension tabs 32 of the upper plate 12 contain a cylindrical pivotable adjusting link 40 which extends between the two upper extension tabs 32 with its central axis generally parallel to the front edge 14 of plate 12. Pivot bolts 41 on either side of the upper extension tabs 32 extend through bores 42 in the extensions 32 and are threaded into the pivot link 40. Pivot washers 43 may also be provided between each of the heads of bolts 41 and the upper extension tabs 32.

Similarly, the bottom plate 13, as shown in FIGS. 2, 3, and 5, has a lower pivotable cylindrical cross link 45 positioned between the lower extension tabs 38 which is also secured with pivot bolts 46 extending through tabs 38 and having washers 48. The central axis of link 45 within the aperture 37 is parallel to the front edge 15 of plate 13 and to the central axis of link 40 as well.

Figure 6:
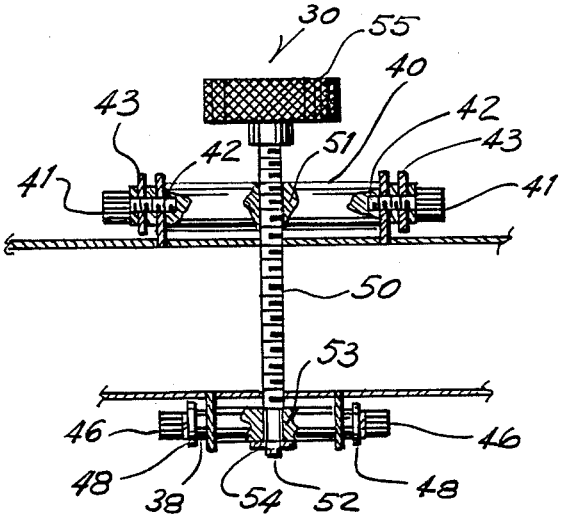
FIG. 6 is a view taken along lines 6—6 of FIG. 2.

As is most clearly shown in FIGS. 2, 3, and 6, the pivot link 40 and lower cross link 45 are interconnected by the screw assembly 30 which includes a threaded shaft 50 which passes through a threaded radial bore 51 through the center of the upper link 40. The lower end of the threaded shaft 50 has a smooth cylindrical shaft portion 52 extending through a radial bore 53 formed in the center of lower link 45. The end of the smooth shaft portion 52 extends through the link 45 and is held in place by a suitable retainer ring 54. The upper or opposite end of the threaded shaft 50 has a knurled head portion 55 attached thereto to aid in the manual turning of the threaded shaft 50 for adjustment purposes.

It will thus be apparent that by turning the threaded shaft 50, the upper cross link 40 will travel up or down the threaded portion of shaft 50 and thus vary the relative distance between the upper link 40 and the lower link 45. Variations in the degree of rotation the central axis of the upper link 40 relative to the central axis of lower link 45 are accommodated by the fact that both links 40 and 45 are pivotally mounted with their axes parallel to one another.

Having thus described the basic construction of the invention, the operative characteristics will now be described.

Depending upon the desired cross sectional shape of an article to be sanded, pivot bolts 22, 26, 41 and 46 are loosened on each side of the sanding device 10. The relative position of the surface planes of plates 12 and 13 may thus be manually adjusted with respect to both their spacial separation and angular relationship by moving the upper plate pivot bolts 26 up or down within the channels 25 of links 20 and by appropriate adjustment of the screw assembly 30. Depending upon the exact relative position of the components of the device, the membrane free section 16 will assume a given radius of curvature, and once the desired radius is obtained, the pivot bolts are tightened to lock the assembly 10 in its selected position. An abrasive sheet may then be placed over the entire surface of the membrane between the plates 12 and 13 and within the radius of curvature. The abrasive material may be in the form of sheet goods such as emery paper or sand paper, adhered to the membrane surface, or the membrane itself could be appropriately treated to have an abrasive surface. The device is then simply placed over the article to be sanded with the abrasive portions contacting the article and sanding accomplished in a conventional manner.

Figure 7:
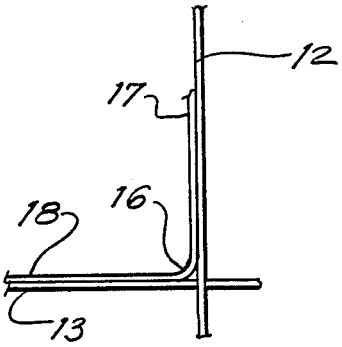
FIG. 7 is a schematic side elevation of the invention in a 90° position of adjustment with minimal curve of membrane.
Figure 8:
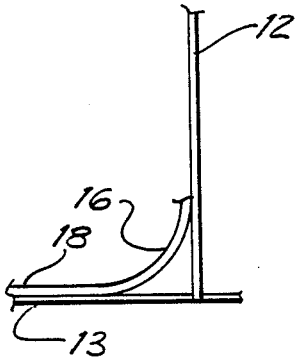
FIG. 8 is a schematic side elevation of the invention in a 90° adjustment with maximum curve of membrane.
Figure 9:
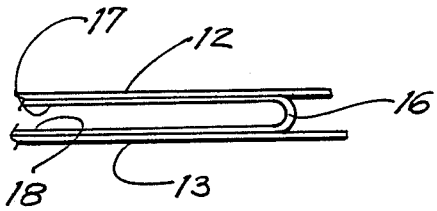
FIG. 9 is a schematic side elevation of the invention in a the upper and lower support surfaces planes in a parallel position and reduced membrane curvature.
Figure 10:
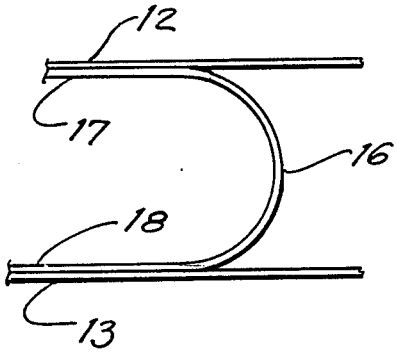
FIG. 10 is a view similar to FIG. 8 with the support surfaces planes spacing expanded.

As schematically seen in FIGS. 7 through 9, within the range of motion permitted by the links 20 and screw assembly 30, the plates 12 and 13 are positionable in an infinite variety of relative angular positions ranging between 90° as shown in FIGS. 7 and 8 and parallel as seen in FIGS. 8 and 9. In FIG. 6 the plates are at a 90° angle with upper plate 12 positioned down in the channel 25 of the links 20 whereby the membrane forms a minimal radius of curvature. Similarly in FIG. 7 by drawing the upper plate 12 upward within the channels 25 of links 20, the radius of curvature of the membrane 16 is broadened to a maximum. The same variation is achievable with the plates in a parallel position as shown in FIG. 8 with the plates relatively close together and as seen in FIG. 9 with the plates in a parallel position but drawn apart to form a greater radius of curvature. Obviously between the parallel position and the 90° position of the plates, infinite varieties of acute angles between those extremes may also be achieved by appropriate adjustment of the linkage and the radius of curvature of the free membrane portion 16 will correspondingly change.

It will also be appreciated to those skilled in the art that this embodiment of the invention permits not only a curved surface to be sanded by virtue of the abrasive medium within the free portion of the membrane 16, but beveled surfaces adjoining the curve may be sanded as well along those portions of the membrane directly supported by the plates 12 and 13.

In one version of the invention as shown, a plate size of 6″ (15.24 cm.) in width was utilized with a total membrane length of 6.142″ (15.60 cm.). The first 1½″ (3.81 cm.) of the membrane portions 17 and 18 were adhesively applied from the leading edges of plates 12 and 13 with a free membrane surface of 3.142″ (7.98 cm.) in length. This permitted the device to be adjusted to achieve radii of curvature varying from ⅛" (0.32 cm.) to 1" (2.54 cm.).

In the preferred embodiment, the plates 12 and 13 are made of steel to provide a rigid support surface for the membrane. The membrane material comprises a mylar sheet. Obviously, many material variations are possible and the plates could be formed of any suitably rigid materials compatible with securing the selected membrane material to them, whether adhesively, fusing, or by other fastening means. Similarly other membrane materials, as long as they have the desired flexibility and elastic deformation properties, could be utilized including sheet metal material such as spring steel, a variety of plastics and other materials suitable for forming an elastically deformable support surface for the abrasive material.

Figure 11:
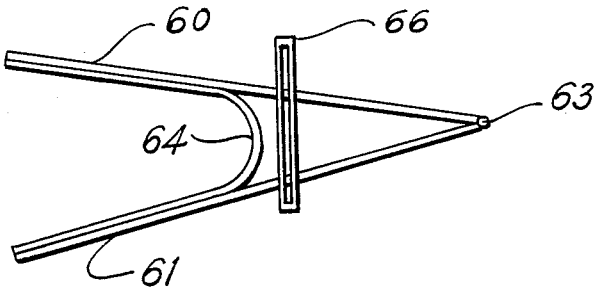
FIG. 11 is a schematic depiction of an alternate form of the invention suitable for sanding convex surfaces.

An alternate embodiment of the invention is schematically depicted in FIG. 11. The exact details of construction are not provided as many of the same features as described in the preferred embodiment would be utilized, however, a pair of plates 60 and 61 have their rear edge joined by a hinge 63 with a flexible membrane 64 secured between the two forward open edges of the plates 60 and 61. A pivotable link 66 is provided on each side of plates 60 and 61 and similar locking bolt type arrangements, not shown, used to secure the plates in a fixed angular relationship. Obviously the relative angle between the plates 60 and 61 will vary the radius of curvature of the free portion of membrane 64, and this embodiment would be somewhat less versatile but also less expensive to construct than the preferred embodiment. In operation, the device would function in a similar fashion to that described for the prior embodiment.

Figure 12:
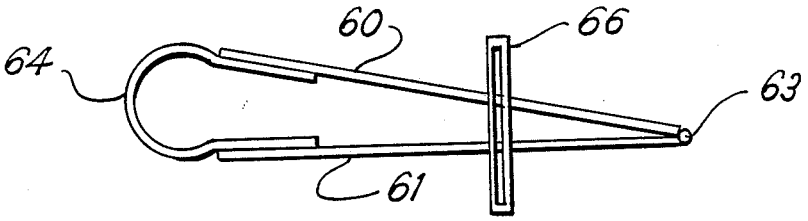
FIG. 12 is a schematic of the alternate version shown in FIG. 11 with the membrane reversed.

A further variation of the alternate embodiment shown in FIG. 11 is shown in FIG. 12 wherein the membrane 64 is reversed to extend forwardly from the plates 60 and 61 to form a convex shape of the free membrane surface 64 which would be suitable for sanding concave surfaces. Obviously the membrane 64 in this variation would have to be of a much more rigid supporting material, but again varying the angle between the plates 60 and 61 would correspondingly vary the radius of curvature of the free surface of membrane 64.

While several variations of the invention have thus been described, those skilled in the art will appreciate that many of the details of construction and the principles incorporated could be varied without departing from the inventive concept. For example although planar supporting plates have been described as preferable, they are preferred along to provide support for sanding beveled surfaces in contact with the abrasive materials adjacent to the plates. If the device were to be utilized only to sand curves, a simple framework could be utilized in place of the planar plates as long as a suitable support connection is provided for the opposing lateral edges of the membrane. Thus, the invention is basically directed to the utilization of a flexible membrane which may form a curved abrasive support surface and including provisions for varying the radius of curvature of the membrane by adjustment of lateral supporting devices. Accordingly, the scope of the invention is to be taken solely from an interpretation of the claims which follow.

I claim:

1. An adjustable sanding device for sanding curved surfaces comprising:

a. flexible membrane means for supporting an abrasive surface, said membrane means having first and second opposed edge portions and a flexible free portion of said membrane means between said opposed edge portions;

b. first support means for supporting said first edge portion of said membrane means;

c. second support means for supporting said second edge portion of said membrane means with said second edge substantially parallel to said first edge portion.

d. linkage means coupled to said first and second support means for permitting said first and second support means to be moved to a plurality of spaced positions relative to one another whereby the radius of curvature of said free portion of said membrane means will correspondingly vary, said linkage means comprising at least one pair of links pivotably connected to opposite sides of said first and second support means; and, e. lock means for locking said first and second support means and said linkage means in preselected spaced positions relative to one another.

2. An adjustable sanding device as set forth in claim 1 wherein:

a. said first support means having a substantially planar first support surface for supporting said first edge portion of said membrane means; and, b. said second support means having a substantially planar second support surface for supporting said second edge portion of said membrane means.

3. An adjustable sanding device as set forth in claim 2 wherein said linkage means havig a first end pivotably coupled to said first support means and a second end pivotably coupled to said second support means for permitting the plane of said first support surface to be angularly varied relative to the plane of said second support surface.

4. An adjustable sanding device as set forth in claim 3 wherein said linkage means including slot means formed therein for permitting the distance between said first and second support surface planes to be selectively varied.

5. An adjustable sanding device as set forth in claim 1 wherein:

a. said first support means comprises a generally rectangular plate having a first edge, an opposed second edge and a planar support surface for supporting said first membrane means edge portion; and, b. said second support means comprises a generally rectangular plate having a first edge, an opposed second edge and a planar support surface for supporting said second membrane means edge portion; and, c. said second edges of said first and second support means being pivotably joined.

6. An adjustable sanding device for sanding curved surfaces comprising:

a. flexible membrane means for supporting an abrasive surface on one side, said membrane means having first and second opposed edge portions and a flexible free portion disposed between said opposed edge portions;

b. first support means for supporting said first edge portion of said membrane means;

c. second support means for supporting said second edge portion substantially parallel to said first edge wherein said membrane means is supported by said first and second support means on its non-abrasive surface, forming said abrasive surface into a concave free portion interior to said sanding device;

d. linkage means comprising at least one pair of links pivotally connected to opposite sides of said first and second support means for permitting said first and second support means to be moved to a plurality of spaced positions relative to one another whereby the radius of curvature of said concave free portion will correspondingly vary; and, e. lock means for locking said first and second support means and said linkage means in preselected spaced positions relative to one another.

7. An adjustable sanding device as set forth in claim 6 wherein said linkage means having a first end pivotably coupled to said first support means and a second end pivotably coupled to said second support means for permitting the plane of said first support surface to be angularly varied relative to the plane of said second support surface.

8. An adjustable sanding device as set forth in claim 7 wherein said linkage means including slot means formed therein for permitting the distance between said first and second support surface planes to be selectively varied.

9. An adjustable sanding device as set forth in claim 6 wherein:

a. said first support means comprises a generally rectangular plate having a first edge, an opposed second edge and a planar support surface for supporting said first membrane means edge portion; and, b. said second support means comprises a generally rectangular plate having a first edge, an opposed second edge and a planar support surface for supporting said second member means edge portion; and, c. said second edges of said first and second support means being pivotably joined.

* * * * *